US005940047A

United States Patent [19]

Pfnister

[11] Patent Number: 5,940,047

[45] Date of Patent: Aug. 17, 1999

[54] SATELLITE ANTENNA COVER DEVICE

[76] Inventor: David Pfnister, 625 Sir Galahad Dr., Lafayette, Colo. 80026

[21] Appl. No.: 09/030,218

[22] Filed: Feb. 25, 1998

[51] Int. Cl.[6] ..... H01Q 1/42

[52] U.S. Cl. ..... 343/872; 343/704

[58] Field of Search ..... 343/872, 704, 343/80; H01Q 1/42

[56] References Cited

U.S. PATENT DOCUMENTS

| | | | |
|---|---|---|---|
| D. 287,588 | 1/1987 | Ulch | D14/231 |
| 3,351,947 | 11/1967 | Hart | 343/872 |
| 3,388,401 | 6/1968 | Weir | 343/872 |
| 3,444,558 | 5/1969 | Leitner | 343/872 |
| 4,126,864 | 11/1978 | Hopkins | 343/872 |
| 4,804,972 | 2/1989 | Schudel | 343/872 |
| 4,811,031 | 3/1989 | Maile et al. | 343/840 |
| 4,918,459 | 4/1990 | De Teso | 343/840 |
| 5,283,592 | 2/1994 | Bogorad et al. | 343/872 |
| 5,406,294 | 4/1995 | Silvey et al. | 343/872 |
| 5,451,972 | 9/1995 | Franklin | 343/840 |
| 5,528,253 | 6/1996 | Franklin | 343/840 |
| 5,815,125 | 9/1998 | Kelly et al. | 343/872 |

FOREIGN PATENT DOCUMENTS

| | | | |
|---|---|---|---|
| 4116095 | 5/1991 | Germany | H01Q 1/42 |
| 63-175504 | 7/1988 | Japan | H01Q 1/42 |

*Primary Examiner*—Don Wong
*Assistant Examiner*—Hoang Nguyen
*Attorney, Agent, or Firm*—Emery L. Tracy

[57] ABSTRACT

A satellite antenna cover device for covering a satellite antenna is provided. The satellite antenna has a satellite dish, an arm extending away from the satellite dish, and a horn mounted to the arm. The device comprises a flexible dish cover with the dish cover covering the satellite dish of the satellite antenna and substantially conforming to the shape of the satellite dish. A flexible arm cover covering the arm of the satellite antenna and substantially conforming to the shape of the arm with the arm cover extending substantially from the satellite dish to the horn. A flexible horn cover substantially conforming to the shape of the horn of the satellite antenna with the horn cover covering the horn of the satellite antenna.

16 Claims, 3 Drawing Sheets

SATELLITE ANTENNA COVER DEVICE

BACKGROUND OF THE INVENTION

1. Field of the Invention

This invention relates generally to a satellite antenna cover device and, more particularly, it relates to a satellite antenna cover device for satellite communication antennas which protects a DSS satellite antenna, including the horn, the arm, and the dish, from a variety of different weather elements 2. Description of the Prior Art In the past, parabolic antennas have been used for government, industrial, and commercial purposes for reception of transmissions from communications satellites. In uses for other than home television signal reception, a variety of forms of covers have been developed for parabolic antennas, mostly for protection against any adverse weather conditions. Such covers have typically been made of rigid plastic material with a spherical or parabolic shape completely enclosing the face of the parabolic antenna including the feed structure located near the focus of the parabola. Furthermore, rigid covers have been employed where the antenna feed structure extends through an opening in the center of the cover.

Protective covers for home satellite dishes have also been produced and marketed over the years. The home satellite dish covers tend to be rather loosely fitting covers which were either flat or extended over some part of the receiver horn support structure. In some cases, a drawstring was utilized to secure the dish cover in a rather fitting fashion.

In an attempt to overcome the shortcomings of the prior art, the Franklin, U.S. Pat. No. 5,528,253, describes a satellite dish cover comprising a flexible fabric cover for an off-axis parabolic or DSS satellite antenna dish having a front surface which serves to cover and protect the front of the antenna dish and the receiver arm. Unfortunately, while covering both the dish and the horn, the dish cover of the Franklin patent does not lay substantially flat against the front of the dish and the material extending to cover the horn creates excess material expense and a non-aesthetically pleasing cover. Furthermore, in high wind areas, the Franklin patent's dish cover would tend to catch the wind thereby causing harm to the dish cover and possibly the entire satellite dish. None of the prior art parabolic antenna covers or other known antenna covers are appropriate to provide an easily emplaceable and easily removable flexible, decorative cover for typical home television antenna dishes.

Accordingly, there exists a need for a satellite antenna dish cover device which is easy to install and easy to replace, when necessary. Additionally, a need exists for a satellite antenna dish cover device which is flexible and aesthetically pleasing. Furthermore, there exists a need for a satellite antenna dish cover device which substantially covers the entire satellite dish including the horn, the arm, and the dish.

SUMMARY OF THE INVENTION

The present invention is a satellite antenna cover device for covering a satellite antenna. The satellite antenna has a satellite dish, an arm extending away from the satellite dish, and a horn mounted to the arm. The device of the present invention comprises a flexible dish cover with the dish cover covering the satellite dish of the satellite antenna and substantially conforming to the shape of the satellite dish. A flexible arm cover covers the arm of the satellite antenna and substantially conforms to the shape of the arm with the arm cover extending substantially from the satellite dish to the horn. A flexible horn cover substantially conforms to the shape of the horn of the satellite antenna with the horn cover covering the horn of the satellite antenna.

In an embodiment of the present invention, the cover device further comprises dish cover securing means on the dish cover for releasably securing the dish cover to the dish portion. Preferably, the dish cover securing means includes a strap having a first end secured to the dish cover and a second free end with the means further including a ring secured to the dish cover and the second end of the strap insertable through the ring and releasably connectable to the first end of the strap to releasably secure the strap to the ring.

In another embodiment of the present invention, the dish cover is separate from the arm cover and the horn cover.

In still another embodiment of the present invention, the cover device further comprises an arm cover securing means on the arm for releasably securing the arm cover to the arm. Preferably, the arm cover securing means includes a hook and loop fastener mechanism.

In yet another embodiment of the present invention, the cover device further comprises means for securing the arm cover to the horn cover. Preferably, the means for securing include stitching the arm cover to the horn cover by threads. Furthermore, preferably, the horn cover is constructed from a transparent material.

In still yet another embodiment of the present invention, the satellite dish has a front side and a back side with the dish cover substantially completely covering both the front side and the back side of the satellite dish.

The present invention further includes a method for covering a satellite antenna. The satellite antenna has a satellite dish, an arm extending away from the satellite dish, and a horn mounted to the arm.

The method of the present invention comprises providing a flexible dish cover, covering the satellite dish of the satellite antenna with the dish cover and substantially conforming the disk cover to the shape of the satellite dish, providing a flexible arm over, extending the arm cover from the satellite dish to the horn, covering the arm of the satellite antenna with the arm cover and substantially conforming the arm cover to the shape of the arm, providing a flexible horn cover substantially conforming to the shape of the horn of the satellite antenna, and covering the horn of the satellite antenna with the horn cover.

In an embodiment of the present invention, the method further comprises releasably securing the dish cover to the dish portion. Preferably, the method comprises providing a strap having a first end secured to the dish cover and a second free end, and a ring secured to the dish cover with the method still further comprising inserting the second end of the strap through the ring and releasably connecting the first end of the strap.

In another embodiment of the present invention, the method further comprises releasably securing the arm cover to the arm. Preferably, the method further comprises providing a hook and loop fastener mechanism.

In still another embodiment of the present invention, the method further comprises securing the arm cover to the horn cover. Preferably, the horn cover is constructed from a transparent material.

In yet another embodiment of the present invention, the satellite dish has a front side and a back side with the method further comprising substantially completely cover is both the front side and the back side of the satellite dish with the dish cover.

DETAILED DESCRIPTION OF THE PREFERRED EMBODIMENTS

Figure 1:
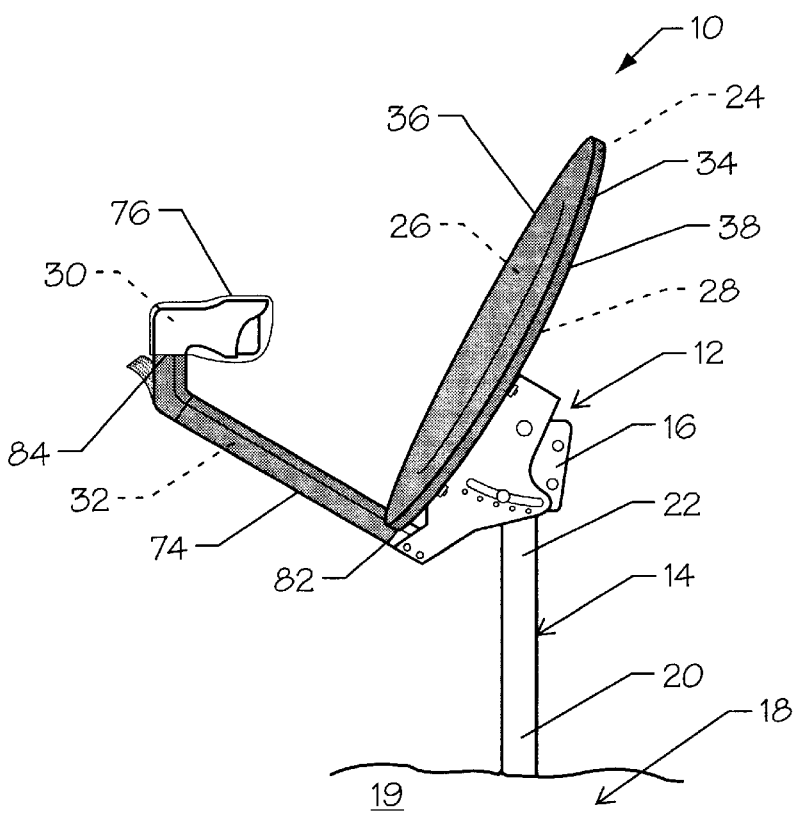
FIG. 1 is a side elevational view illustrating the satellite antenna cover device constructed in accordance with the present invention.
Figure 6:
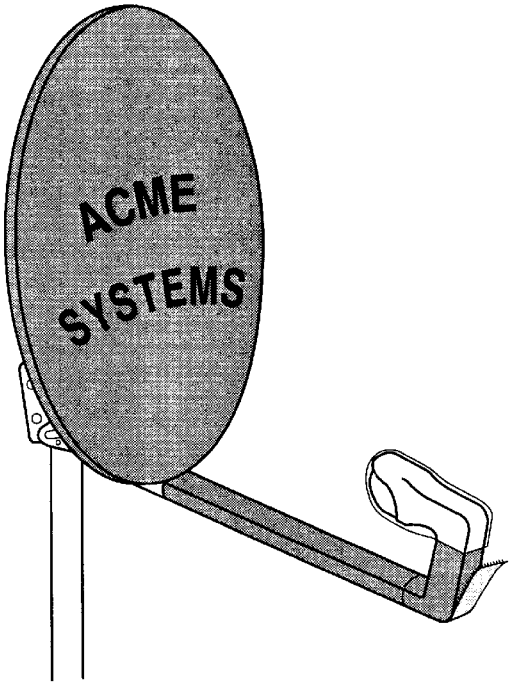
FIG. 6 is a perspective view illustrating another type of satellite antenna for use with the satellite antenna cover device constructed in accordance with the present invention.

As illustrated in FIG. 1, the present invention is a satellite antenna cover device, indicated generally at 10, for covering a small off-axis parabolic satellite antenna 12 such as the satellite antennas commonly referred to as DSS antennas for DSS digital satellite systems currently produced by GM Hughes Electronics and other various companies. While the cover device 10 of the present invention will be described hereafter for covering a small off-axis parabolic satellite antenna as illustrated in FIG. 1 or an oblique-type satellite antenna as illustrated in FIG. 6, it is within the scope of the present invention to have the cover device 10 cover any type of government, industrial, commercial, or home satellite antenna regardless of either size or whether the satellite antenna is an off-axis satellite antenna or another type of satellite antenna including, but not limited to oblique-type antennas currently produced by Primestar.

To a person skilled in the art, it will be understood that the structures of the various satellite antennas with which the dish cover 10 of the present invention may be used form no part of the invention and are shown so that the features and advantages of the dish cover 10 of the present invention can be better explained. In fact, the structure of the satellite antenna 12 illustrated in the accompanying drawings is strictly conventional and does not form a part of the present invention.

Still referring to FIG. 1, typically, the satellite antenna 12 has an upright support 14 and a connection bracket 16 mounted to the upright support 14. The upright support 14 has a first end 20 and a second end 22 opposite the first end 20. The first end 20 of the upright support 14 is preferably mounted to a stable surface 18 including, but not limited to, the ground 19 or the side of a house (not shown). The connection bracket 16 is mounted to the second end 22 of the upright support 14 in a known fashion, e.g., by a plurality of screws or bolts.

Although there are substantial variations in the million or more of such satellite antennas in use, the satellite antenna 12 further includes, with few exceptions as noted above, a satellite dish 24 of a generally circular shape in the overall configuration formed in a concave dish shape, generally of shallow, parabolic form. The satellite dish 24 has a front concave surface 26 and a back surface 28 substantially opposite the front concave surface 26. The back surface 28 of the satellite dish 24 is mounted to the connection bracket 16 in a known fashion, e.g., by a plurality of screws or bolts. In addition, typically, the satellite antenna 12 will have an antenna feed element 30 (generally referred to as a horn or cone) supported generally centrally and at a predetermined distance in front of the front concave surface 26 of the satellite dish 24 by a support element arm 32. It should be noted that it is within the present invention to have the horn 30 be of any size or shape.

The cover device 10 of the present invention includes a dish cover 34 having a shape substantially equal to the shape of the satellite dish 24 of the satellite antenna 12. The dish cover 34 has a first front portion 36 and a second back portion 38 sewn or otherwise attached to the first front portion 36. The dish cover 34 is constructed such that when the dish cover 34 is releasably mounted about the satellite dish 24, the first front portion 36 of the dish cover 24 is nearingly adjacent the front concave surface 26 of the satellite dish 24 and the second back portion 38 of the dish cover 34 is nearingly adjacent the back surface 28 of the satellite dish 24. Preferably, the dish cover 34 is constructed of a heavy, weather-resistant flexible material such as fabric to withstand a variety of weather events and to inhibit foreign objects from damaging the dish cover 34. It should be noted, however, that other materials including, but not limited to, vinyl, plastic, etc., can be used for construction of the dish cover 34 are within the scope of the present invention.

In order to assist in installation of the dish cover 34 on the satellite dish 24 of the satellite antenna 12, the dish cover 34 further includes a slit or split 40 formed in the second back side 38 of the dish cover 34. The slit 40 of the dish cover 34 is defined by a first slit edge 42 and a second slit edge 44 substantially opposite the first slit edge 42. The slit 40 allows the dish cover 34 to open sufficiently to allow the dish cover 34 to be easily installed over the satellite dish 24 of the satellite antenna 12 and around the connection bracket 16 as will be described in further detail below.

Figure 2:
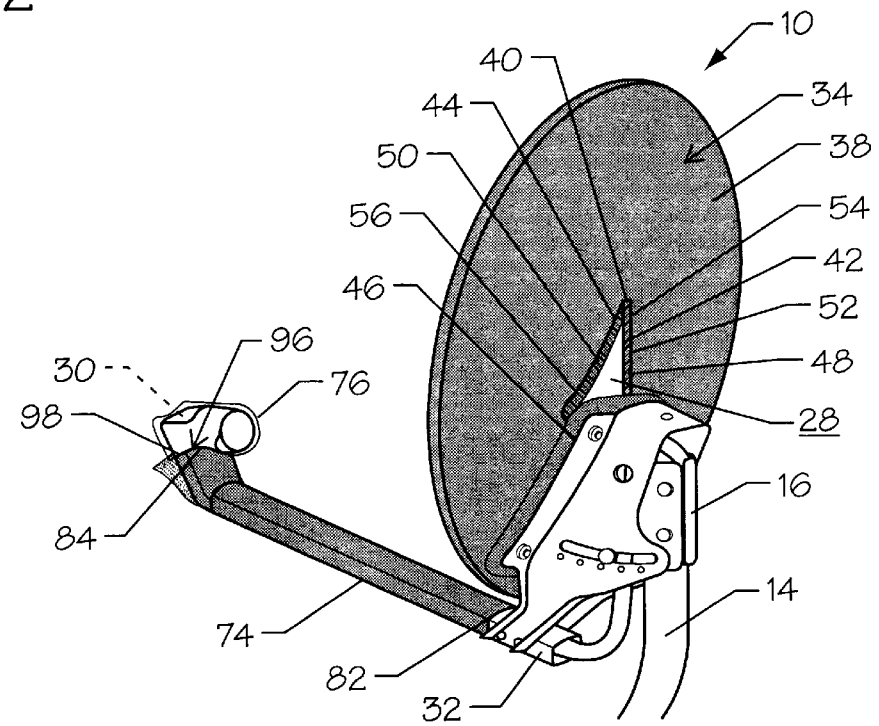
FIG. 2 is a rear perspective view illustrating the satellite antenna cover device constructed in accordance with the present invention.
Figure 3:
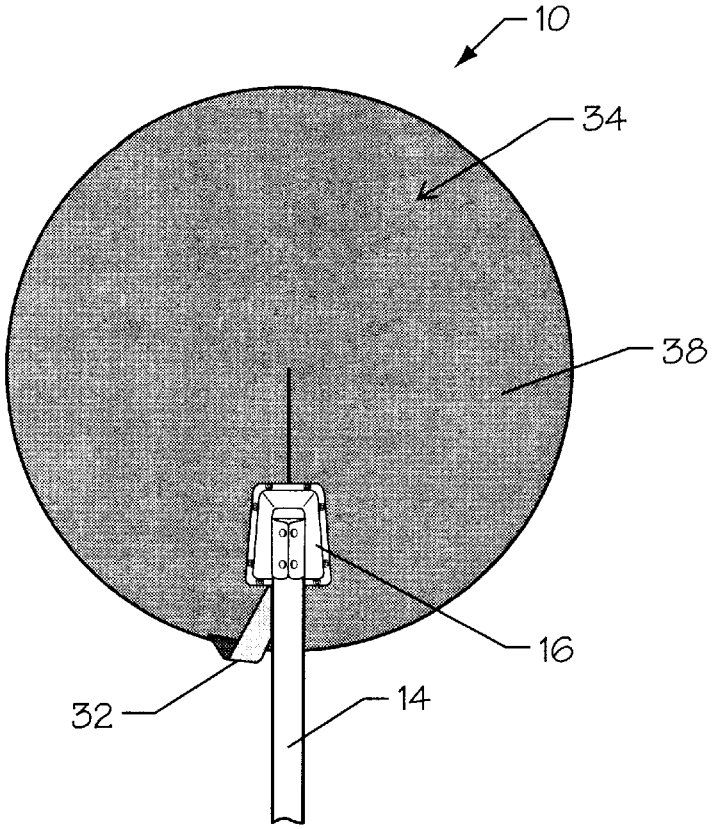
FIG. 3 is a rear elevational view illustrating the satellite antenna cover device constructed in accordance with the present invention.
Figure 4:
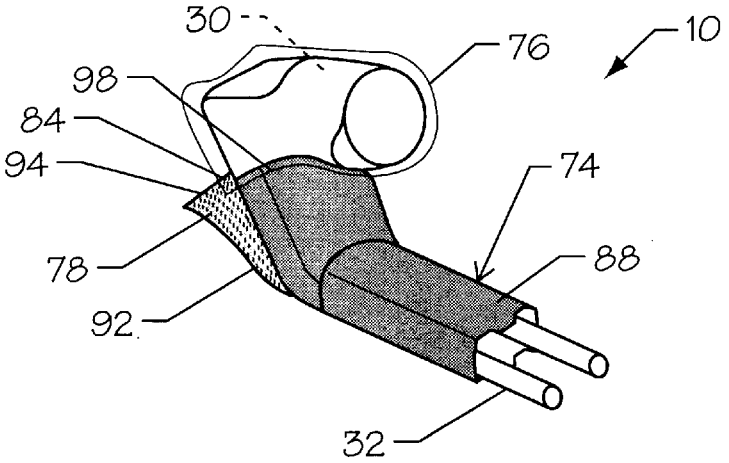
FIG. 4 is a perspective view illustrating the horn cover and a portion of the arm cover of the satellite antenna cover device constructed in accordance with the present invention.

As illustrated in FIGS. 2 and 3, the dish cover 34 further has an aperture or cut-out 46 formed in the second back portion 38 on each side of the slit 40 of the dish cover 34. The aperture 46 is sized to generally conform to the size of the footprint of the connection bracket 16 of the satellite antenna 12 against the satellite dish 12. Due to the aperture 46, the slit 40 further comprises a first slit portion 48 generally above the aperture 46 and the connection bracket 16 and a second slit portion 50 generally below the aperture 46 and the connection bracket 16.

The dish cover 34 further includes a first dish cover fastening mechanism 52, preferably a hook and loop fastening mechanism, i.e., VELCRO, is mounted on the first slit portion 48 with a hook portion 54 being mounted on either the first slit edge 42 or the second slit edge 44 of the first slit portion 48 and a loop portion 56 being mounted on the opposite slit edge 42, 44. The first dish cover fastening mechanism 52 allows the dish cover 34 to be releasably secured and closed about the satellite dish 24 inhibiting weather elements and foreign objects from entering between the dish cover 34 and the satellite dish 24 through the first slit portion 48.

Figure 5:
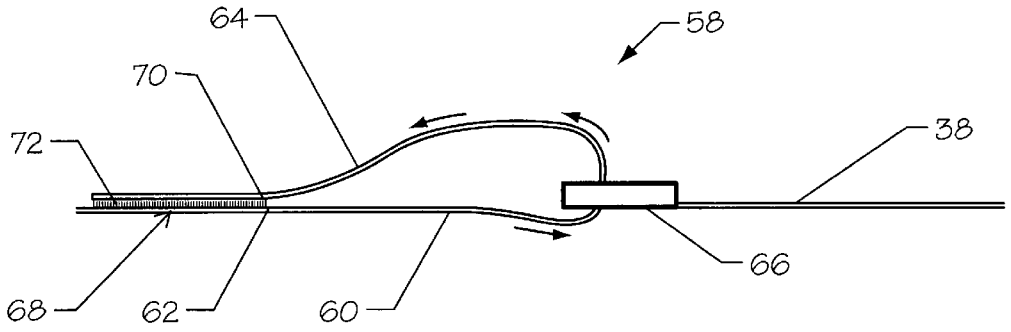
FIG. 5 is a side elevational view illustrating a mechanism for attaching the satellite antenna cover device to a satellite dish constructed in accordance with the present invention.

As illustrated in FIG. 5, the dish cover 34 also includes a second dish cover fastening mechanism 58 releasably securing the first slit edge 42 of the second slit portion 50 to the second slit edge 44 of the second slit portion 50. Preferably, the second fastening mechanism 58 has a strap 60 having a first secured end 62 and a second free end 64 with the first secured end 62 mounted adjacent the first slit edge 42 of the second slit portion 50 on the second backside 38 of the dish cover 34. The strap 60 has a hook and loop fastener 68 mounted thereon with a hook portion 70 mounted on the second free end 64 and a loop portion 72 mounted between the hook portion 70 and the first secured end 62 of the strap 60.

The second fastening mechanism 58 further has a ring 66 mounted adjacent the second slit edge 44 of the second slit portion 50. The second free end 64 of the strap 60 is insertable through the ring 66 and the strap 60 is folded back upon itself until the hook portion 70 mates with the loop portion 72 thereby allowing the dish cover 34 to be releasably secured about the satellite dish 24 and to inhibit weather elements and foreign objects from entering between the dish cover 34 and the satellite dish 24 around the connection bracket 16 and through the second slit portion 50.

As illustrated in FIGS. I and 4, the cover device 10 of the present invention further includes an arm cover 74 and a horn cover 76. The arm cover 74 is preferably 12 constructed from the same material as the dish cover 34, however, constructing the arm cover 74 from a different material or materials than the dish cover 34 is within the scope of the present invention. The arm cover 74 is preferably a substantially flat, rectangular piece of material having a first edge 78, a second edge 80 substantially opposite and parallel to the first edge 78, a third edge 82 substantially perpendicular to the first edge 78 and the second edge 80, a fourth edge 84 substantially opposite and parallel to the third edge 82, a first side surface 86, and a second side surface 88 substantially opposite the first side surface 86. As will be described further below, when the arm cover 74 is releasably secured to the arm 32 of the satellite antenna 12, the third edge 82 of the arm cover 74 is positioned generally nearingly adjacent the satellite dish 24 and the fourth edge 84 of the arm cover 74 is positioned generally nearingly adjacent the horn 30 of the satellite antenna 12.

The arm cover 74 further has an arm cover fastening mechanism 90 for releasably securing the arm cover 74 to the arm 32 of the satellite antenna 12. The arm cover fastening mechanism 90 is preferably a hook and loop fastener, i.e., VELCRO, with a hook portion 92 being on either the first edge 78 or the second edge 80 of the arm cover 74 and a loop portion 94 being on either opposite edge 78, 80 thereby allowing the arm cover 74 to be releasably secured and closed about the arm 32 of the satellite antenna 12 inhibiting weather elements and foreign objects from entering between the arm cover 74 and the arm 32 of the satellite antenna 12.

The horn cover 76 is preferably constructed from a transparent material, i.e., a clear plastic, which conforms generally to the size and shape of the horn 30. The transparent material of the horn cover 76 allows the horn 30 to receive the signals transmitted from the satellite dish 24 to the horn 30 without the inherent interference of a translucent material.

The horn cover 76 has an aperture 96 formed therein for allowing the horn cover 76 to be releasably installed over the horn 30 of the satellite antenna 12. The aperture 96 of the horn cover 76 is defined an edge 98. The edge 98 of the horn cover 76 is preferably secured to the fourth edge 84 of the arm cover 74 by stitching or other means.

Installation of the cover device 10 of the present invention will now be described. First, the first dish cover fastening mechanism 52 and the second dish cover fastening mechanism 58 are released allowing the first slit edge 42 and the second slit edge 44 of both the first slit portion 48 and the second slit portion 50 to be separated thereby opening the dish cover 34 sufficiently to allow the dish cover 34 to be easily installed over the satellite dish 24. Next, the dish cover 34 is installed over the satellite dish 24. The first dish cover fastening mechanism 52 is then manipulated to close the first slit portion 48 about the satellite dish 24. Next, the second free end 64 of the strap 60 is inserted into the ring 66 and pulled to tighten the first slit edge 42 of the second slit portion 50 toward the second slit edge 44 of the second slit portion 50. The second dish cover fastening mechanism 58 is then manipulated to maintain releasable closure of the second slit portion 50 and securely releasably secure the dish cover 34 to the satellite dish 24 of the satellite antenna 12.

After the dish cover 34 has been installed to protect the satellite dish 24 of the satellite antenna 12, the arm cover 74 and the horn cover 76 are installed to protect the arm 32 and the horn 30, respectively, of the satellite antenna 12. First, the horn 30 of the satellite antenna 12 is inserted into the horn cover 76 through the aperture 96 of the horn cover 76. The third end 82 of the arm cover 74 is manipulated to a position nearingly adjacent the satellite dish 24 with the first side surface 86 of the arm cover 74 being positioned nearingly adjacent the arm 32 of the satellite antenna 12. The arm cover 74 is then snugly wrapped around the arm 32 until the first edge 78 and the second edge 80 meet about the arm 32. The arm cover fastening mechanism 90 is then manipulated to securely releasably secure the arm cover 74 and the horn cover 76 to the arm 32 and the horn 30 of the satellite antenna 12.

With the cover device 10 of the present invention, a novel and unique manner of protecting a satellite antenna 12 has been discovered. The cover device 10 substantially conforms to the satellite dish 24, the arm 32, and the horn 30 of the satellite antenna 12 significantly reducing the profile of the cover device. The reduced profile of the cover device 10 of the present invention inhibits strong winds and other adverse weather elements from acting on the cover device 10 inhibiting the strong winds and other adverse weather elements from damaging either the cover device 10 or the satellite antenna 12 itself.

Furthermore, since the dish cover 34 substantially conforms to the shape of the satellite dish 24, the cover device 10 of the present invention provides an aesthetically pleasing covering for the satellite antenna 12. It is possible to apply advertising material or decorative designs to the dish cover 34 depending on the desires of the satellite antenna 12 owner.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A satellite antenna cover device for covering a satellite antenna, the satellite antenna having a satellite dish, an arm extending away from the satellite dish, and a horn mounted to the arm, the satellite antenna cover device comprising:

a flexible dish cover, the dish cover covering the satellite dish of the satellite antenna and substantially conforming to the shape of the satellite dish;

a flexible arm cover, the arm cover covering the arm of the satellite antenna and substantially conforming to the shape of the arm, the arm cover extending substantially from the satellite dish to the horn;

a flexible horn cover substantially conforming to the shape of the horn of the satellite antenna, the horn cover covering the horn of the satellite antenna; and means for securing the arm cover to the horn cover.

2. The cover device of claim 1 wherein the means for securing include stitching the arm cover to the horn cover by threads.

3. The cover device of claim 1 and further comprising dish cover securing means on the dish cover for releasably securing the dish cover to the dish portion.

4. The cover device of claim 3 wherein the dish cover securing means includes a strap having a first end secured to the dish cover and a second free end, the dish cover securing means further including a ring secured to the dish cover, the second end of the strap insertable through the ring and releasably connectable to the first end of the strap to releasably secure the strap to the ring.

5. The cover device of claim 1 wherein the dish cover is separate from the arm cover and the horn cover.

6. The cover device of claim 1 and further comprising arm cover securing means on the arm for releasably securing the arm cover to the arm.

7. The cover device of claim 6 wherein the arm cover securing means includes a hook and loop fastener mechanism.

8. The cover device of claim 1 wherein the horn cover is constructed from a transparent material.

9. The cover device of claim 1 wherein the satellite dish has a front side and a back side, the dish cover substantially completely covering both the front side and the back side of the satellite dish.

10. A method for covering a satellite antenna, the satellite antenna having a satellite dish, an arm extending away from the satellite dish, and a horn mounted to the arm, the method comprising:

providing a flexible dish cover;

covering the satellite dish of the satellite antenna with the dish cover and substantially conforming the disk cover to the shape of the satellite dish;

providing a flexible arm cover;

extending the arm cover from the satellite dish to the horn;

covering the arm of the satellite antenna with the arm cover and substantially conforming the arm cover to the shape of the arm;

providing a flexible horn cover substantially conforming to the shape of the horn of the satellite antenna;

covering the horn of the satellite antenna with the horn cover; and securing the arm cover to the horn cover.

11. The method of claim 10 and further comprising releasably securing the dish cover to the dish.

12. The method of claim 11 and further comprising providing a strap having a first end secured to the dish cover and a second free end, and a ring secured to the dish cover, the method still further comprising inserting the second end of the strap through the ring and releasably connecting the first end of the strap.

13. The method of claim 10 and further comprising releasably securing the arm cover to the arm portion.

14. The method of claim 13 and further comprising providing a hook and loop fastener mechanism.

15. The method of claim 10 and further comprising constructing the horn cover from a transparent material.

16. The method of claim 10 wherein the satellite dish has a front side and a back side, the method further comprising substantially completely covering both the front side and the back side of the satellite dish with the dish cover.

* * * * *